US006752512B2

(12) United States Patent
Pan

(10) Patent No.: US 6,752,512 B2
(45) Date of Patent: Jun. 22, 2004

(54) DECORATIVE LAMP-TREE

(76) Inventor: Wun Fang Pan, No. 123, Lane 99, Pu Din Road, Hsinchu (TW)

( * ) Notice: Subject to any disclaimer, the term of this patent is extended or adjusted under 35 U.S.C. 154(b) by 0 days.

(21) Appl. No.: 10/195,538

(22) Filed: Jul. 16, 2002

(65) Prior Publication Data

US 2004/0012950 A1 Jan. 22, 2004

(51) Int. Cl.[7] ..... F21S 6/00
(52) U.S. Cl. ..... 362/123; 362/227; 362/806
(58) Field of Search ..... 362/122, 123, 362/252, 241, 806, 227

(56) References Cited

U.S. PATENT DOCUMENTS 4,072,857 A * 2/1978 DeVicaris ..... 362/123
5,700,081 A * 12/1997 Mengle et al. ..... 362/123
D398,257 S * 9/1998 McMahon ..... D11/118
5,975,717 A * 11/1999 Rahman ..... 362/251

* cited by examiner

*Primary Examiner*—Laura K. Tso
(74) *Attorney, Agent, or Firm*—Rosenberg, Klein & Lee

(57) ABSTRACT

A decorative lamp-tree is provided. The decorative lamp-tree includes a decorative light bulb string (2) for connection to a tree including a trunk (1) having a plurality of branches (11) projecting from the trunk (1), with a plurality of sub-branches (12) projecting from each branch (11). The light bulb string (2) is arranged into a plurality of branch strings (21) for attachment to the respective branches (11), with each branch string (21) having a plurality of sub-branch strings (22) projecting therefrom for attachment to sub-branches (12). The branch strings (21) and sub-branch strings (22) of light bulbs are connected to the respective branches (11) and sub-branches (12) by connection means (3).

4 Claims, 3 Drawing Sheets

DECORATIVE LAMP-TREE

BACKGROUND OF THE INVENTION

A conventional Christmas tree, such as a pine, is usually used for holiday decoration; the tree includes a trunk, many branches, and leaves while a light bulb string is wound around the tree. To wind the known straight light bulb string on the tree is very inconvenient and the bulbs are easily disordered on the tree, which ruins the decorative effect.

Accordingly, the primary object of the invention is to provide a decorative lamp-tree, which includes a trunk having many branches and a special light bulb string for attachment to the tree. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
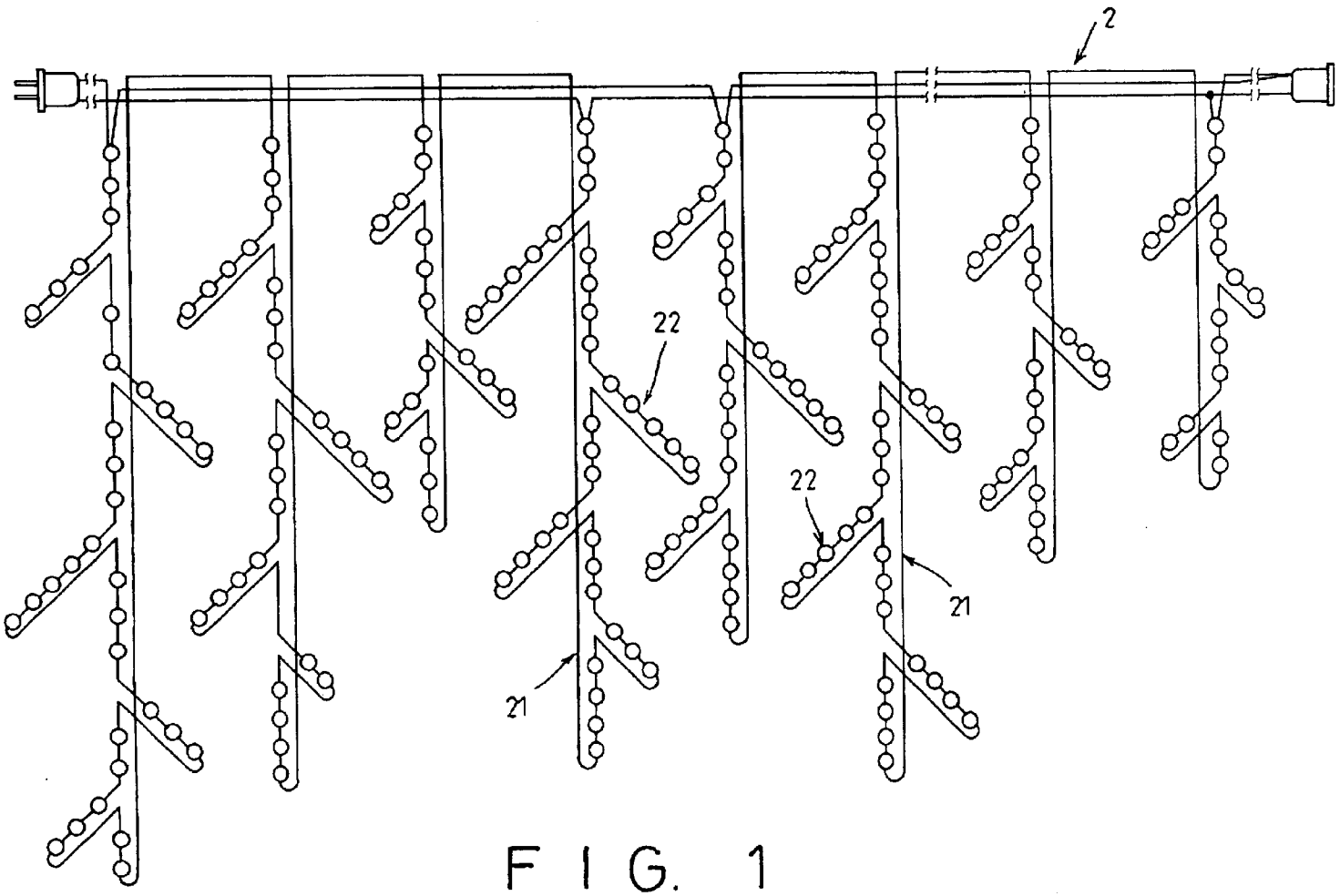
FIG. 1 is a plan view showing a decorative light bulb string according to the present invention.
Figure 2:
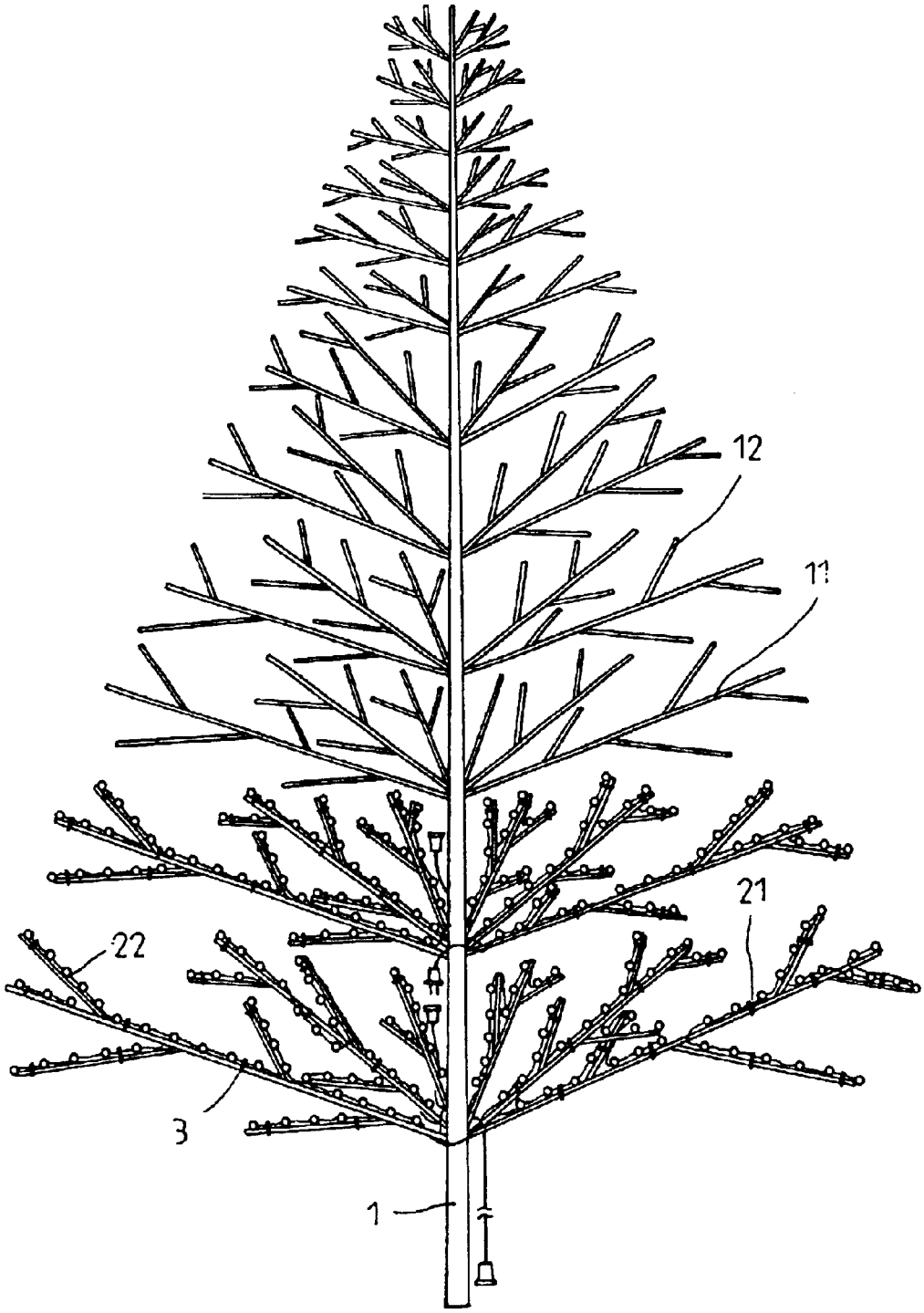
FIG. 2 is a plan view showing a decorative lamp-tree hanging with the light bulb string of FIG. 1; and, FIGS. 3 and 4 show a perspective view of one embodiment of a connector used in the present invention.

Referring to FIGS. 1 and 2, the present invention mainly provides a lamp-tree structure, which includes a pine-like assembly and a decorative light bulb string (2). The pine-like assembly is composed of a trunk (1), many branches (11) connected with the trunk (1), and many tails (2) connected with each of the branches (11). The light bulb string (2) includes several branch strings (21) and several extended strings (22) connected with each of the branch strings (21). Hence, when the light bulb string (2) is wound around the lamp-tree, a branch string (21) can be wound on a branch (11) and each extended string (22) can be wound around a tail (12) of the branch (11).

It is known that the present invention uses a special light bulb string for winding around a branch or a tail to form a perfect lamp-tree to show every bulb in a well distributed manner. This produces a better decorative effect than prior art systems.

Figure 3:
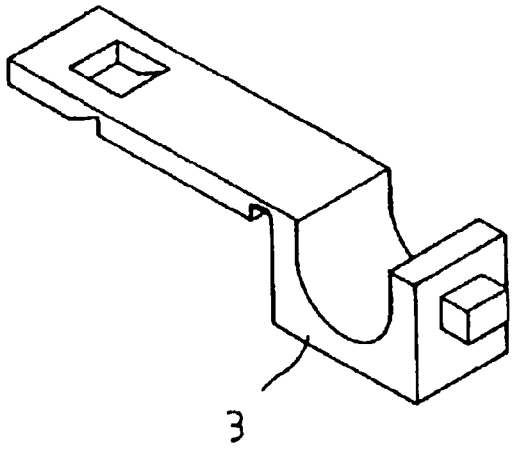
Figure 4:
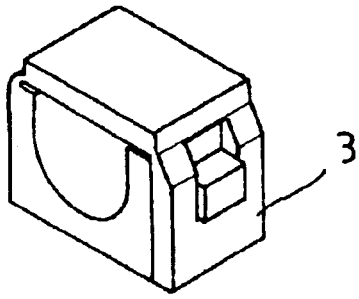

As shown in FIGS. 3 and 4, a connector (3) can be used for attaching the string (2) to the branch (11) or the tail (12) easily and securely. The embodiment is only an exemplary one and does not limit the scope of this invention.

What is claimed is:

1. A decorative lamp tree system comprising:

a plurality of light bulbs mounted on an electrical wire, adjacent ones of said plurality of light bulbs being in electrical communication with one another, said plurality of light bulbs being divided into a plurality of branch sets, each said branch set being configured for placement on one of a plurality of main branches of a tree, each said branch set being divided into a plurality of sub-branch sets of said light bulbs, each said sub-branch set being configured for placement on one of a plurality of sub-branches projecting from one of said main branches; and, connecting means for securely fastening said branch sets and said sub-branch sets of said plurality of light bulbs to respective ones of said main branches and said sub-branches of said tree, said connecting means including:

(a) a base connector member having an open slot formed therein; and, (b) a foldable connector cover member foldable over a top surface of said base connector member for providing a closed through passage whereby said main branch or sub-branch and a portion of said electrical wire is captured therein.

2. The decorative lamp tree system as recited in claim 1 where said connector cover member includes a cover latch opening for receiving a lug member formed on said base connector member.

3. The decorative lamp tree system as recited in claim 2 where said cover member includes a pair of hinges for folding said connector cover member over a top surface of said base connector member and a side surface thereof.

4. The decorative lamp tree system as recited in claim 3 where said lug member extends from said side surface of said base connector member for insert into said cover latch opening.

* * * * *